US012796728B2

(12) United States Patent
Seo et al.

(10) Patent No.: US 12,796,728 B2
(45) Date of Patent: Nov. 17, 2026

(54) SMOKING ARTICLE AND AEROSOL GENERATING SYSTEM INCLUDING THE SAME

(71) Applicant: KT&G CORPORATION, Daejeon (KR)

(72) Inventors: Jung Kyu Seo, Daejeon (KR); Da Bin Song, Daejeon (KR); Young Rim Han, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 403 days.

(21) Appl. No.: 18/289,616

(22) PCT Filed: Feb. 24, 2023

(86) PCT No.: PCT/KR2023/002631
§ 371 (c)(1),
(2) Date: Nov. 6, 2023

(87) PCT Pub. No.: WO2023/167468
PCT Pub. Date: Sep. 7, 2023

(65) Prior Publication Data

US 2024/0251845 A1 Aug. 1, 2024

(30) Foreign Application Priority Data

Mar. 4, 2022 (KR) ..... 10-2022-0028304

(51) Int. Cl.
*A24D 1/20* (2020.01)
*A24B 15/10* (2006.01)
(Continued)

(52) U.S. Cl.
CPC ..... *A24D 1/20* (2020.01); *A24B 15/10* (2013.01); *A24D 1/002* (2013.01); *A24D 1/02* (2013.01); *A24D 1/045* (2013.01); *A24F 40/20* (2020.01)

(58) Field of Classification Search
None
See application file for complete search history.

(56) References Cited

U.S. PATENT DOCUMENTS 5,374,869 A * 12/1994 Bowen ..... A24D 3/04 313/331
2010/0108085 A1 5/2010 Duke
(Continued)

FOREIGN PATENT DOCUMENTS

CA 3139015 A1 2/2022
CN 105722415 A 6/2016
(Continued)

OTHER PUBLICATIONS

Communication issued Oct. 1, 2024 in Japanese application No. 2023-564215.
(Continued)

*Primary Examiner* — Dennis R Cordray
(74) *Attorney, Agent, or Firm* — Sughrue Mion, PLLC

(57) ABSTRACT

A smoking article includes a medium accommodation portion filled with a plurality of tobacco sheets, a moisturizer accommodation portion disposed on one side of the medium accommodation portion and including an aerosol generating material, and a filter portion disposed on another side of the medium accommodation portion. The plurality of tobacco sheets may be manufactured using base paper having a basis weight less than that of existing base paper.

15 Claims, 2 Drawing Sheets

(51) Int. Cl.

| | |
|---|---|
| ***A24D 1/00*** | (2020.01) |
| ***A24D 1/02*** | (2006.01) |
| ***A24D 1/04*** | (2006.01) |
| ***A24F 40/20*** | (2020.01) |

(56) References Cited

U.S. PATENT DOCUMENTS

| | | | | |
|---|---|---|---|---|
| 2020/0229485 | A1 | 7/2020 | Gindrat | |
| 2023/0025403 | A1* | 1/2023 | Grishchenko | A24D 3/061 |
| 2023/0078050 | A1* | 3/2023 | D'Ambra | A24D 1/20 131/352 |

FOREIGN PATENT DOCUMENTS

| | | | |
|---|---|---|---|
| CN | 109645560 | A | 4/2019 |
| CN | 113100470 | A | 7/2021 |
| JP | 2021-511798 | A | 5/2021 |
| KR | 10-0558809 | B1 | 3/2006 |
| KR | 10-1406395 | B1 | 6/2014 |
| KR | 10-2017-0131381 | A | 11/2017 |
| KR | 10-2020-0054156 | A | 5/2020 |
| KR | 10-2020-0061290 | A | 6/2020 |
| WO | 2020/250108 | A1 | 12/2020 |
| WO | 2021/019016 | A1 | 2/2021 |
| WO | 2021/123843 | A1 | 6/2021 |
| WO | 2022045518 | A1 | 3/2022 |

OTHER PUBLICATIONS

Office Action issued Apr. 14, 2025 in Korean Patent Application No. 10-2022-0028304.

International Search Report for PCT/KR2023/002631 dated May 26, 2023.

Written Opinion for PCT/KR2023/002631 dated May 26, 2023.

Extended European Search Report dated Feb. 11, 2026, issued in European application No. 23763667.5.

Communication issued Jun. 24, 2026 in Chinese Patent Application No. 202380024967.0.

* cited by examiner

SMOKING ARTICLE AND AEROSOL GENERATING SYSTEM INCLUDING THE SAME

CROSS REFERENCE TO RELATED APPLICATIONS

This application is a National Stage of International Application No. PCT/KR2023/002631 filed Feb. 24, 2023, claiming priority based on Korean Patent Application No. 10-2022-0028304 filed Mar. 4, 2022.

TECHNICAL FIELD

The present disclosure relates to a smoking article, and an aerosol generating system including the smoking article.

BACKGROUND ART

Recently, demands for alternative ways to overcome disadvantages of general cigarettes have increased. For example, there is a growing demand for a method of generating an aerosol by heating an aerosol generating material included in a cigarette rather than by burning the cigarette.

DISCLOSURE OF THE INVENTION

Technical Goals

A technical goal to be achieved by the present disclosure is to provide a smoking article including a medium accommodation portion filled with a tobacco sheet manufactured using base paper having a basis weight less than that of existing base paper.

In addition, the present disclosure provides an aerosol generating device that may provide an aerosol that is inhalable by a user by heating an aerosol generating material stored in the smoking article.

In addition, the present disclosure provides an aerosol generating system including the smoking article and the aerosol generating device.

However, technical goals to be achieved are not limited to those described above, and other goals not mentioned above are clearly understood by one of ordinary skill in the art from the following description.

Technical Solutions

To solve the above problems, the present disclosure provides a smoking article including a medium accommodation portion filled with a tobacco sheet manufactured using base paper having a basis weight less than that of existing base paper.

In an embodiment of the present disclosure, the smoking article may include a medium accommodation portion filled with a plurality of tobacco sheets, a moisturizer accommodation portion disposed on one side of the medium accommodation portion and including an aerosol generating material, and a filter portion disposed on another side of the medium accommodation portion.

In another embodiment of the present disclosure, each of the tobacco sheets may have a basis weight of about 20 grams per square meter (gsm) to about 50 gsm and desirably about 35 gsm.

In another embodiment of the present disclosure, each of the tobacco sheets may have a paper width of about 200 millimeters (mm) to about 250 mm, and desirably 220 mm.

In another embodiment of the present disclosure, each of the tobacco sheets may have a thickness of about 50 micrometers (μm) to about 100 μm and desirably 85 μm.

In another embodiment of the present disclosure, in the smoking article, a resistance to draw of the medium accommodation portion may be ¼ of a resistance to draw of the moisturizer accommodation portion.

In another embodiment of the present disclosure, each of the tobacco sheets may be formed by folding a flat sheet coated with a tobacco medium multiple times.

In another embodiment of the present disclosure, the tobacco medium may include at least one of glycerin, propylene glycol, and nicotine.

In another embodiment of the present disclosure, the tobacco medium may include about 0.08 milligrams (mg) to about 2.5 mg of glycerin and desirably 1.6 mg of glycerin, based on 1 mm that is a length of the medium accommodation portion.

In another embodiment of the present disclosure, the aerosol generating material may include glycerin (Gly) and propylene glycol (PG), and optionally include nicotine.

In another embodiment of the present disclosure, the filter portion may include a first filter portion including a cavity therein, and a second filter portion filled with a filtration material.

In another embodiment of the present disclosure, at least one of the medium accommodation portion, the moisturizer accommodation portion, and the filter portion may be wrapped with a segment wrapper.

In another embodiment of the present disclosure, a plurality of segments wrapped with the segment wrapper may be wrapped with a total wrapper.

In another embodiment of the present disclosure, the medium accommodation portion may have a resistance to draw of about 50 $mmH_2O$ to about 70 $mmH_2O$. More specifically, an encapsulated pressure drop (EPD) may be about 58 $mmH_2O$ immediately after a smoking article is manufactured, and may be about 60 $mmH_2O$ after conditioning.

In another embodiment of the present disclosure, the smoking article may have an encapsulated pressure drop (EPD) of about 90 $mmH_2O$ to about 110 $mmH_2O$ and desirably about 103.8 $mmH_2O$, and have an unencapsulated pressure drop (UPD) of about 40 $mmH_2O$ to about 55 $mmH_2O$ and desirably about 53.4 $mmH_2O$.

The present disclosure also provides an aerosol generating device that is configured to provide an aerosol inhalable by a user by heating an aerosol generating material stored in the smoking article.

In an embodiment of the present disclosure, the aerosol generating device may be configured to receive the smoking article.

In another embodiment of the present disclosure, the aerosol generating device may include an elongated cavity configured to accommodate the smoking article, a heater configured to heat the medium accommodation portion and the moisturizer accommodation portion of the smoking article, and a controller electrically connected to the heater.

In addition, the present disclosure provides an aerosol generating system including the smoking article and the aerosol generating device.

Effects

According to embodiments, a smoking article, an aerosol generating device, and an aerosol generating system may include a medium accommodation portion including a tobacco sheet manufactured using base paper having a basis weight less than that of existing base paper. Accordingly, a resistance to draw is reduced when compared with an existing smoking article.

According to embodiments, a smoking article, an aerosol generating device, and an aerosol generating system may increase an amount of migration of nicotine, glycerin, or menthol.

According to embodiments, a smoking article, an aerosol generating device, and an aerosol generating system may increase an amount of atomization.

According to embodiments, a smoking article, an aerosol generating device, and an aerosol generating system may be easily inhaled by a consumer and provide good smoking taste.

The effects of the smoking article, the aerosol generating device and the aerosol generating system according to an embodiment are not limited to the above-mentioned effects, and other unmentioned effects can be clearly understood from the following description by one of ordinary skill in the art.

BEST MODE FOR CARRYING OUT THE INVENTION

Figure 1:
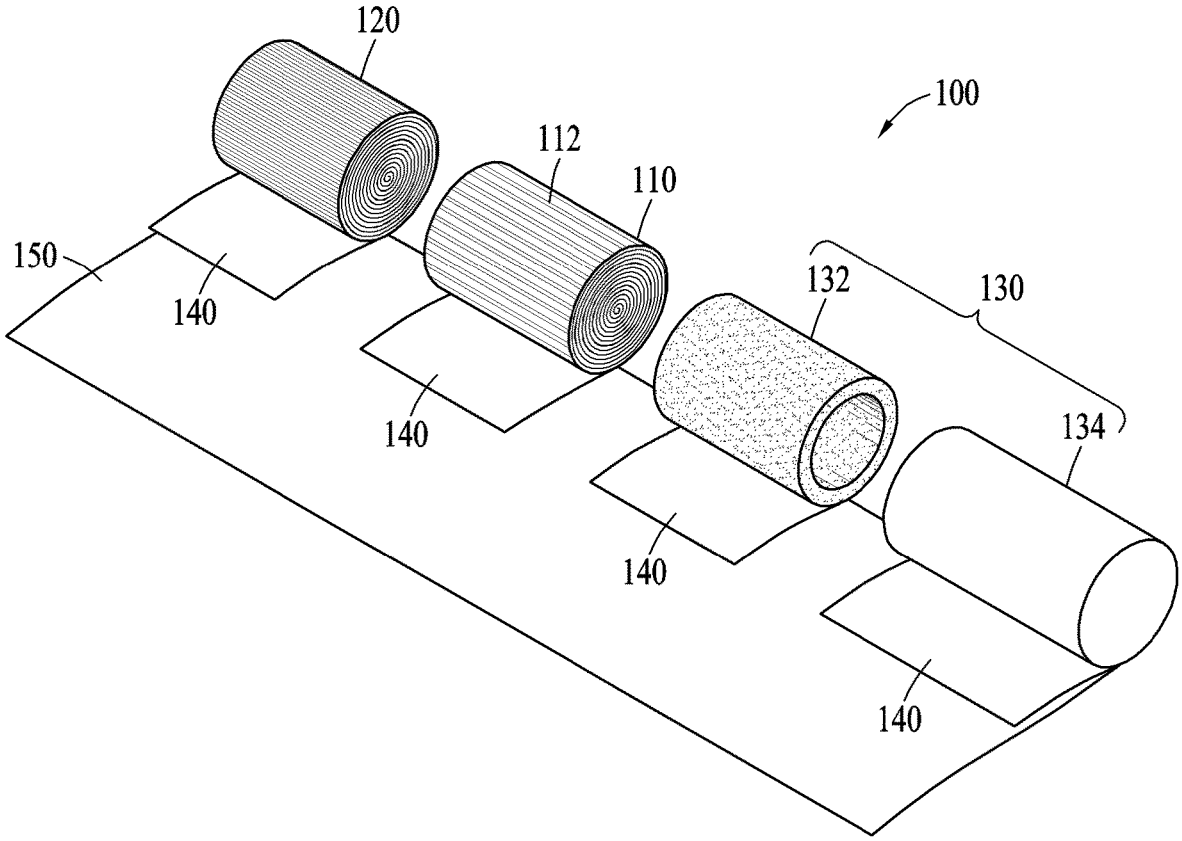
FIG. 1 illustrates a diagram of a smoking article according to an embodiment.

Hereinafter, embodiments will be described in detail with reference to the accompanying drawings. However, various alterations and modifications may be made to the embodiments. Here, the embodiments are not construed as limited to the disclosure. The embodiments should be understood to include all changes, equivalents, and replacements within the idea and the technical scope of the disclosure.

The terminology used herein is for the purpose of describing particular embodiments only and is not intended to be limiting. The singular forms "a," "an," and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

Unless otherwise defined, all terms including technical and scientific terms used herein have the same meaning as commonly understood by one of ordinary skill in the art to which the embodiments belong. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

When describing the embodiments with reference to the accompanying drawings, like reference numerals refer to like components and a repeated description related thereto will be omitted. In the description of embodiments, detailed description of well-known related structures or functions will be omitted when it is deemed that such description will cause ambiguous interpretation of the present disclosure.

In addition, terms such as first, second, A, B, (a), (b), and the like may be used to describe components of the embodiments. These terms are used only for the purpose of discriminating one component from another component, and the nature, the sequences, or the orders of the components are not limited by the terms. It should be noted that if one component is described as being "connected," "coupled" or "joined" to another component, the former may be directly "connected," "coupled," and "joined" to the latter or "connected", "coupled", and "joined" to the latter via another component.

A component, which has the same common function as a component included in any one embodiment, will be described by using the same name in other embodiments. Unless otherwise described, the description on one embodiment may be applicable to another embodiment and thus, redundant description will be omitted for conciseness.

FIG. 1 illustrates a diagram of a smoking article according to an embodiment.

Referring to FIG. 1, a smoking article 100 according to an embodiment may include a medium accommodation portion 110, a moisturizer accommodation portion 120 disposed on one side of the medium accommodation portion 110 to generate an aerosol, and a filter portion 130 disposed on another side of the medium accommodation portion 110. The smoking article 100 may include a plurality of segments, such as the medium accommodation portion 110, the moisturizer accommodation portion 120, and the filter portion 130. The segments of the smoking article 100 may or may not be individually wrapped with a segment wrapper 140. Segments wrapped with the segment wrapper 140 may be wrapped again with a total wrapper 150 to form a single smoking article.

In the present disclosure, the medium may include a solid material that is based on raw tobacco materials, such as reconstituted tobacco sheets, cut tobacco leaves, reconstituted tobacco, or the like, and/or a liquid composition that is based on glycerin, propylene glycol, nicotine, menthol, caffeine, y-aminobutyric acid (GABA), taurine, vitamin, or various flavoring agents, but is not limited thereto.

In the present disclosure, the medium accommodation portion 110 may be filled with a plurality of tobacco sheets 112. The plurality of tobacco sheets 112 may be manufactured using base paper having a paper width greater than that of base paper used in a medium accommodation portion of an existing smoking article and having a basis weight and a thickness smaller than those of the base paper used in the medium accommodation portion of the existing smoking article. Thus, a smoking article with a significantly reduced resistance to draw may be provided. Preferably, base paper of the tobacco sheets 112 may be configured so that the resistance to draw of the medium accommodation portion 110 is ¼ of the resistance to draw of the moisturizer accommodation portion 120.

More specifically, a tobacco sheet according to an embodiment may have a basis weight of about 20 grams per square meter (gsm) to about 50 gsm, desirably about 35 gsm. If the basis weight is extremely greater than the above basis weights, the tobacco sheet may be insufficiently crimped due to relatively thick paper. If the basis weight is extremely low, it may be difficult to form a filter rod because paper is relatively thin and easily torn. In addition, a tobacco sheet according to an embodiment may have a thickness of about 50 micrometers (μm) to about 100 μm, desirably about 85 μm.

A tobacco sheet according to an embodiment may have a paper width of about 200 millimeters (mm) to about 250 mm, desirably about 220 mm. If the paper width is extremely greater than the above paper widths, filter equipment, such as a size of a bobbin, a crimping device and all manufacturing equipment, may need to be upgraded. If the paper width is extremely low, it may be considerably difficult to form a filter rod because a filter needs to be filled with a predetermined amount of paper.

Physical properties of base paper of a tobacco sheet used in the present disclosure are shown in Table 1 below.

TABLE 1

| Item | Unit | Control group | Experimental group |
|---|---|---|---|
| Paper width | mm | 150 | 220 |
| Basis weight | $g/m^2$ | 60 | 35 |
| Thickness | μm | 147 | 85 |
| Whiteness | % | 70 or greater | 70 or greater |
| Tensile strength | kgf/15 mm | 4.0 or greater | 1.5 or greater |
| Extension rate | % | 13 or greater | 10 or greater |
| Fiber composition | — | — | 50% of birch pulp or greater |

Each of the tobacco sheets 112 may be formed by folding a flat sheet coated with a tobacco medium multiple times. Here, the tobacco medium may be in a liquid form. The tobacco medium may include about 0.08 milligrams (mg) to about 2.5 mg of glycerin per 1 mm length of the medium accommodation portion 110.

The medium accommodation portion 110 may have a length of about 10 mm to about 14 mm, desirably about 12 mm. The tobacco sheets 112 may contain about 1 to 30 mg/12 mm of glycerin, desirably about 20 mg/12 mm of glycerin. If the amount of glycerin is extremely less than the above amounts, the amount of atomization may be insufficient. If the amount of glycerin is extremely large, a filter plug wetting phenomenon may occur, which may result in poor manufacturing workability and a significant increase in a resistance to draw in comparison to a target level.

The medium accommodation portion 110 may further contain other additives such as an additional moisturizer, a flavoring agent, and/or an organic acid. The additional moisturizer may be, for example, ethylene glycol, dipropylene glycol, diethylene glycol, triethylene glycol, tetraethylene glycol, or oleyl alcohol, but is not limited thereto. The flavoring agent may be, for example, licorice, sucrose, fructose syrup, isosweet, cocoa, lavender, cinnamon, cardamom, celery, fenugreek, cascarilla, sandalwood, bergamot, geranium, honey essence, rose oil, vanilla, lemon oil, orange oil, mint oil, cinnamon, caraway, cognac, jasmine, chamomile, menthol, cassia, ylang-ylang, sage, spearmint, ginger, coriander, or coffee, but is not limited thereto.

In the present disclosure, the moisturizer accommodation portion 120 may contain a moisturizer. The moisturizer may include glycerin and propylene glycol, and may further include at least one of ethylene glycol, dipropylene glycol, diethylene glycol, triethylene glycol, tetraethylene glycol, oleyl alcohol, and water. In addition, the moisturizer accommodation portion 120 may further include nicotine. However, materials included in the moisturizer accommodation portion 120 are not limited thereto. The moisturizer may maintain an appropriate level of moisture in an aerosol generated when a smoking article is heated, thereby mellowing a unique taste of tobacco and enriching an amount of atomization.

In the present disclosure, the filter portion 130 may include at least one segment, and may include, for example, at least one of a tube filter, a cooling structure, and a recess filter. Desirably, the filter portion 130 may include a first filter portion 132 including a cavity therein, and a second filter portion 134 fully filled with a filtration material. The filtration material may include a cellulose-based material (e.g., acetate, paper, etc.).

To measure a resistance to draw, analyze aerosol components, and perform sensory evaluation with respect to a smoking article according to an embodiment, a smoking article was manufactured as shown in Table 2 below.

TABLE 2

| Classification | Moisturizer accommodation portion | Medium accommodation portion | Filter portion |
|---|---|---|---|
| Control group | 50 mg of solution with glycerin 99.05% and nicotine stock solution 0.95% (Resistance to draw of 250 $mmH_2O$) | 20 mg of glycerin Crepe paper with basis weight of 60 gsm and width of 150 mm | Same (first filter portion and second filter portion) |
| Experimental group | | 20 mg of glycerin Base paper with basis weight of 35 gsm and width of 220 mm | |

Experimental Example 1. Measurement of Resistance to Draw

First, Table 3 shows results obtained by measuring a resistance to draw of a medium accommodation portion formed of base paper with a reduced basis weight.

TABLE 3

| Classification | Weight (mg) | Circumference (mm) | EPD ($mmH_2O$)_immediately after manufacturing | EPD ($mmH_2O$)_after conditioning |
|---|---|---|---|---|
| Control group | 855 | 22.02 | 93 | 95 |
| Experimental group | 784 | 22.05 | 58 | 60 |

As a result of a comparison with a control group where a medium accommodation portion is formed of crepe paper, the control group has an encapsulated pressure drop (EPD) of 93 $mmH_2O$ immediately after manufacturing and an EPD of 95 $mmH_2O$ after conditioning, while the experimental group has an EPD of 58 $mmH_2O$ immediately after manufacturing and an EPD of 60 $mmH_2O$ after conditioning, which were about 40% less than the control group, respectively.

Table 4 shows results obtained by measuring a resistance to draw of a smoking article including the medium accommodation portion.

TABLE 4

| Classification | Weight (mg) | Circumference (mm) | Vent (%) | UPD ($mmH_2O$) | EPD ($mmH_2O$) |
|---|---|---|---|---|---|
| Control group | 642 | 22.65 | 65.0 | 58.5 | 114.6 |
| Experimental group | 634 | 22.68 | 65.3 | 53.4 | 103.8 |

As a result of a comparison with a control group where a medium accommodation portion is formed of crepe paper, the control group has an unencapsulated pressure drop (UPD) of 58.5 $mmH_2O$ and an EPD of 114.6 $mmH_2O$, while the experimental group has an UPD of 53.4 $mmH_2O$ and an EPD of 103.8 $mmH_2O$, which were significantly reduced.

Experimental Example 2. Analysis of Aerosol Components

Table 5 shows results obtained by analyzing components of an aerosol generated by 9 puffs and pack diffusion conditions using a Health Canada (HC) method that is an internationally recognized analysis method for general cigarettes.

TABLE 5

| | HC conditions, 9 puffs, pack diffusion, PV1-2 | | | | | | |
|---|---|---|---|---|---|---|---|
| Classification | TPM | Tar | Nic. | PG | Gly. | Water | Menthol |
| Control group | 26.0 | 15.1 | 0.18 | 0.05 | 9.29 | 10.7 | 0.79 |
| Experimental group | 28.7 | 16.7 | 0.20 | 0.06 | 10.76 | 11.8 | 1.00 |

As a result of designing a medium accommodation portion with a reduced resistance to draw, it is confirmed that an aerosol of the experimental group contains a significantly large amount of total particulate matter (TPM), total aerosol residue (Tar), nicotine, propylene glycol, glycerin, water, and menthol, in comparison to the control group. In particular, an amount of migration of nicotine is increased by 11%, an amount of migration of glycerin is increased by 16% and an amount of migration of menthol is increased by 26%. This indicates that a smoking article according to an embodiment of the present disclosure has a greater amount of atomization and is excellent in taste and flavor, based on a reduced resistance to draw.

When menthol or the like is flavored using a spray method (e.g., a transfer jet nozzle system (TJNS)) in a tobacco medium of the medium accommodation portion of the smoking article, an EPD of a filter rod increases to about 200 $mmH_2O$, and the amount of migration of glycerin rapidly decreases.

Experimental Example 3. Sensory Evaluation

An amount of atomization, suction resistance performance, an intensity of smoking taste, an intensity of menthol, stimulus properties of menthol, balance, and overall satisfaction of the smoking article of the control group (crepe paper) and the experimental group (base paper with a reduced base weight) were evaluated. Sensory evaluation was measured by a 7-point scoring method after about 10 to 14 puffs of experts with experience in sensory evaluation in the field of smoking articles, and results of the sensory evaluation are shown in Table 6 below.

TABLE 6

| Classification | Amount of atomization | Suction resistance performance | Intensity of smoking taste | Intensity of menthol** | Stimulus properties of menthol | Balance** | Overall satisfaction** |
|---|---|---|---|---|---|---|---|
| Control group | 4.8 | 3.9 | 3.0 | 4.3 | 3.1 | 4.2 | 4.2 |
| Experimental group | 5.3 | 4.4 | 3.0 | 4.7 | 3.3 | 4.6 | 4.6 |
| P-value | 0.043 | 0.092 | 0.391 | 0.003 | 0.297 | 0.011 | 0.011 |

(Significance level * 1%, 5%)

As a result, an amount of atomization, suction resistance performance, an intensity of menthol, stimulus properties of menthol, balance, and the overall satisfaction of the smoking article were all increased. In particular, it is confirmed that the above two groups are statistically significantly different from each other in the amount of atomization, the intensity of menthol, the balance, and the overall satisfaction.

Figure 2:
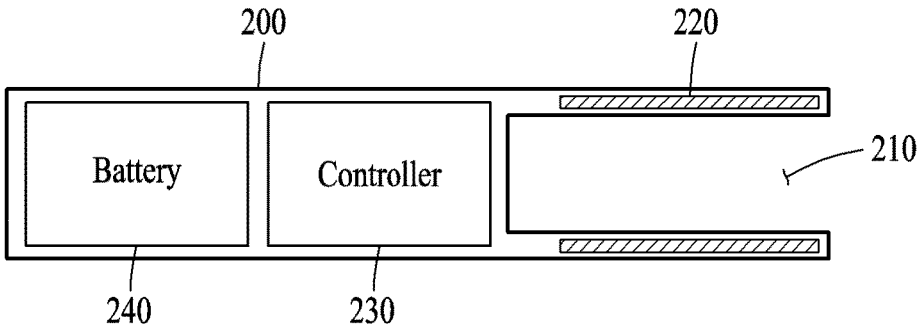
FIG. 2 is a diagram schematically illustrating an aerosol generating device according to an embodiment.
Figure 3:
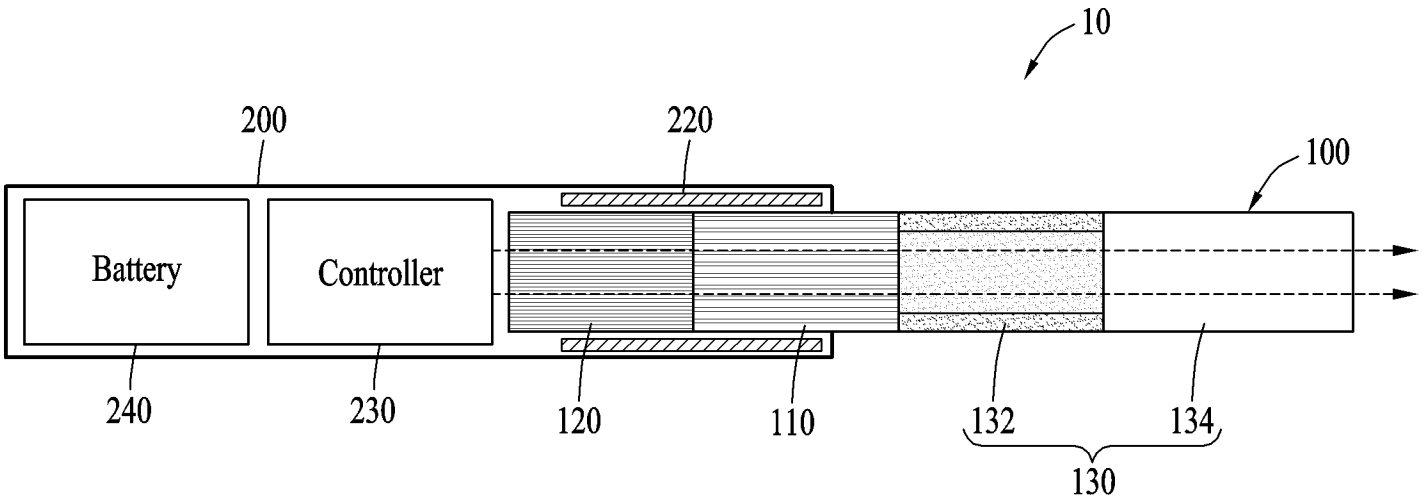
FIG. 3 is a diagram schematically illustrating an aerosol generating system in a state in which a smoking article and an aerosol generating device are coupled, according to an embodiment.

FIGS. 2 and 3 illustrate examples in which a smoking article 100 including a medium accommodation portion 110 formed of base paper having a basis weight less than that of existing base paper is used.

FIG. 2 is a diagram schematically illustrating an aerosol generating device 200 according to an embodiment.

Referring to FIG. 2, the aerosol generating device 200 may include an elongated cavity 210, a heater 220, and a controller 230. The elongated cavity 210 may be configured to accommodate the smoking article 100. The controller 230 may be electrically connected to the heater 220 to control a temperature to heat the smoking article 100. The aerosol generating device 200 may further include a battery 240 configured to supply power in a process of generating an aerosol.

FIG. 3 is a diagram schematically illustrating an aerosol generating system 10 in a state in which a smoking article 100 and an aerosol generating device 200 are coupled, according to an embodiment.

Referring to FIG. 3, the aerosol generating system 10 may include the smoking article 100, and the aerosol generating device 200. The smoking article 100 may be coupled to tightly fit an elongated cavity 210 of the aerosol generating device 200. In the state in which the smoking article 100 is coupled to the aerosol generating device 200, the heater 220 may heat at least a part or all of a medium accommodation portion 110 and a moisturizer accommodation portion 120 of the smoking article 100.

While the embodiments are described with reference to drawings, it will be apparent to one of ordinary skill in the art that various alterations and modifications in form and details may be made in these embodiments without departing from the spirit and scope of the claims and their equivalents. For example, suitable results may be achieved if the described techniques are performed in a different order, and/or if components in a described system, architecture, device, or circuit are combined in a different manner, and/or replaced or supplemented by other components or their equivalents.

Therefore, other implementations, other embodiments, and equivalents to the claims are also within the scope of the following claims.

What is claimed is:

1. A smoking article comprising:

a medium accommodation portion filled with a plurality of tobacco sheets;

a moisturizer accommodation portion disposed on one side of the medium accommodation portion and immediately adjacent to the medium accommodation portion in a longitudinal direction, the moisturizer accommodation portion comprising an aerosol generating material; and a filter portion disposed on another side of the medium accommodation portion in the longitudinal direction, wherein a resistance to draw of the medium accommodation portion is less than a resistance to draw of the moisturizer accommodation portion, and wherein each of the tobacco sheets has a basis weight of about 20 grams per square meter (gsm) to about 50 gsm.

2. The smoking article of claim 1, wherein each of the tobacco sheets has a thickness of about 50 micrometers (μm) to about 100 μm.

3. The smoking article of claim 1, wherein each of the tobacco sheets has a paper width of about 200 millimeters (mm) to about 250 mm.

4. The smoking article of claim 1, wherein the resistance to draw of the medium accommodation portion is ¼ of a resistance to draw of the moisturizer accommodation portion.

5. The smoking article of claim 1, wherein each of the tobacco sheets is formed by folding a flat sheet coated with a tobacco medium multiple times.

6. The smoking article of claim 5, wherein the tobacco medium comprises at least one of glycerin, propylene glycol, and nicotine.

7. The smoking article of claim 6, wherein the tobacco medium comprises about 0.08 milligrams (mg) to about 2.5 mg of glycerin per 1 mm length of the medium accommodation portion.

8. The smoking article of claim 1, wherein the aerosol generating material comprises glycerin and propylene glycol, and optionally comprises nicotine.

9. The smoking article of claim 1, wherein the filter portion comprises:

a first filter portion comprising a cavity; and a second filter portion filled with a filtration material.

10. The smoking article of claim 1, wherein at least one segment of the medium accommodation portion, the moisturizer accommodation portion, and the filter portion is wrapped with a segment wrapper.

11. The smoking article of claim 10, wherein a plurality of segments comprising the medium accommodation portion, the moisturizer accommodation portion, and the filter portion are wrapped with the segment wrapper, and the segment wrapper is wrapped with a total wrapper.

12. The smoking article of claim 1, wherein the medium accommodation portion has a resistance to draw of about 50 $mmH_2O$ to about 70 $mmH_2O$.

13. An aerosol generating device, wherein the aerosol generating device is configured to receive the smoking article of claim 1 and provide an aerosol by heating the aerosol generating material stored in the smoking article.

14. The aerosol generating device of claim 13, comprising:

an elongated cavity configured to accommodate the smoking article;

a heater configured to heat the medium accommodation portion and the moisturizer accommodation portion of the smoking article; and a controller electrically connected to the heater.

15. An aerosol generating system comprising:

the smoking article of claim 1; and an aerosol generating device configured to receive the smoking article of claim 1 and provide an aerosol by heating the aerosol generating material stored in the smoking article.

* * * * *